US007753563B2

(12) United States Patent
Parker

(10) Patent No.: US 7,753,563 B2
(45) Date of Patent: Jul. 13, 2010

(54) DISPLAY DEVICE

(75) Inventor: Alan Parker, Witney (GB)

(73) Assignee: Beadlight Limited, Oxon (GB)

( * ) Notice: Subject to any disclaimer, the term of this patent is extended or adjusted under 35 U.S.C. 154(b) by 234 days.

(21) Appl. No.: 11/662,169

(22) PCT Filed: Sep. 6, 2005

(86) PCT No.: PCT/GB2005/003434

§ 371 (c)(1),
(2), (4) Date: Aug. 15, 2007

(87) PCT Pub. No.: WO2006/027570

PCT Pub. Date: Mar. 16, 2006

(65) Prior Publication Data

US 2008/0273328 A1 Nov. 6, 2008

(30) Foreign Application Priority Data

Sep. 8, 2004 (GB) ..... 0419922.0

(51) Int. Cl.
*F21V 3/00* (2006.01)
*F21V 5/00* (2006.01)
*F21V 11/00* (2006.01)

(52) U.S. Cl. ..... 362/311.03; 362/311.01; 362/330; 362/355

(58) Field of Classification Search ..... 362/355, 362/330, 97, 97.1, 97.2, 604, 605, 614, 153, 362/153.1, 267, 311.01, 311.02, 311.03, 362/311.05, 311.13, 311.14; 349/61, 62, 349/64

See application file for complete search history.

(56) References Cited

U.S. PATENT DOCUMENTS 3,309,806 A * 3/1967 Gallagher ..... 40/570
4,035,690 A * 7/1977 Roeber ..... 345/41

(Continued)

FOREIGN PATENT DOCUMENTS

DE 20003428 4/2000

(Continued)

OTHER PUBLICATIONS

English machine translation of DE 102 12 417.*

(Continued)

*Primary Examiner*—Jong-Suk (James) Lee
*Assistant Examiner*—David R Crowe
(74) *Attorney, Agent, or Firm*—Davis & Bujold, P.L.L.C.

(57) ABSTRACT

A display device comprising a body for housing first and second transparent members and a carrier that supports sources of light. The first member is spaced from the second member such that a first plenum chamber is formed between the first and second members. The carrier is spaced from the second member on a side of the second member opposite the first chamber such that a second plenum chamber is formed between the second member and the carrier. A spacer separates the carrier from the second member by a predetermined amount. The sources of light being directed at the first and second members and the first and second chambers. The first chamber is filled with optical particles to diffuse the light passing through. The carrier applies a load, via the spacer, on the second member such that the particles are maintained at a pressure.

15 Claims, 4 Drawing Sheets

U.S. PATENT DOCUMENTS

| | | | | |
|---|---|---|---|---|
| 4,716,503 | A | 12/1987 | Chappell et al. | |
| 4,929,021 | A * | 5/1990 | Kaye | 297/188.09 |
| 6,336,735 | B1 * | 1/2002 | Eddins | 362/351 |
| 6,923,548 | B2 * | 8/2005 | Lim | 362/612 |
| 7,052,152 | B2 * | 5/2006 | Harbers et al. | 362/30 |
| 2004/0227870 | A1 * | 11/2004 | Jang | 349/64 |

FOREIGN PATENT DOCUMENTS

| | | | |
|---|---|---|---|
| DE | 10060364 | | 4/2002 |
| DE | 10212417 | | 10/2003 |
| DE | 10212417 | A1 * | 10/2003 |
| DE | 10242292 | | 4/2004 |
| EP | 1081426 | | 3/2001 |
| EP | 1394465 | | 3/2004 |
| FR | 2688575 | | 9/1993 |
| FR | 2771888 | | 6/1999 |
| FR | 2771888 | A1 * | 6/1999 |
| FR | 2858390 | A1 * | 2/2005 |
| GB | 2392488 | | 3/2004 |
| JP | 2004 158224 | | 6/2004 |
| WO | WO 2005 019726 | | 3/2005 |

OTHER PUBLICATIONS

Machine translation of FR 2771888.*

* cited by examiner

DISPLAY DEVICE

This application is a national stage completion of PCT/GB2005/003434 filed

Sep. 6, 2005 which claims priority from British Application Serial No. 0419922.0 filed Sep. 8, 2004.

TECHNICAL FIELD

This invention relates to a display device. In particular it is concerned with a display device providing for effective use of light from a light source. The device can also serve as an illumination device.

BACKGROUND ART

For a given power input light output from a light source can vary between that from a relatively small size source (say a light emitting diode) to that from a relatively large size source (say a resistive filament). A relatively high powered source tends to generate light more efficiently than, a low powered one. However high intensity light in a display device can dazzle a viewer.

One way to overcome the matter of dazzle is to configure the illumination system so that direct viewing of the illuminating means cannot occur. Another way is to overcome dazzle is to provide an optical filter but this necessarily attenuates the light output so rendering superfluous the use of a relatively high powered source.

The matter of dazzle is not usually a critical matter in connection with an illuminating means where the viewer is meant to look at an object illuminated by the illuminating means rather than the means itself. However a display device is intended to be viewed directly and consequently any output display by means of the device should not contain a viewable region of dazzling brightness.

DISCLOSURE OF THE INVENTION

According to a first aspect of the present invention there is provided a display device comprising:

a body member having a side member which, in plan view, conforms to a first profile;

a first transparent member located within, and by, the body member the first transparent member having a boundary conforming to and lying within the first profile, a second transparent member located within, and by, the body member the second transparent member having a boundary conforming to and lying within the first profile and being spaced from the first transparent member so as to provide a first plenum chamber bounded by the first and second transparent body members and the body member;

a carrier having a plurality of sources of light located on it located by the body member and spaced from the second transparent member on the opposite side of the second transparent member to the first plenum chamber so as to provide a second plenum chamber bounded by the carrier, the second transparent body member and the body member; the plurality of lights being directed into the second plenum, chamber;

spacing means providing for the distancing of the carrier from the second transparent member by a predetermined amount;

a closure member for, and secured to, the body member whereby the carrier is maintained in contact with the second transparent member;

the first plenum chamber having a filling of optical particles such as chips or balls of glass; the carrier serving to load the second transparent member by way of the spacing means so that the filling is maintained as a pressurised mass of particles; and means providing for the plurality of sources of light to be connectable to at least one source of power to enable at least one of the sources to be energised.

According to a first preferred version of the first aspect of the present invention each source of light is a light emitting solid state device and the optical particles are glass balls.

According to a second preferred version of the first aspect of the present invention or of the first preferred version thereof the optical particles are of uniform size and shape.

According to a third preferred version of the first aspect of the present invention or of the first preferred version thereof the optical particles vary in size over a spectrum of sizes.

According to a fourth preferred version of the first aspect of the present invention or of any preceding preferred version thereof the optical particles are of similar shape.

According to a fifth preferred version of the first aspect of the present invention or of any of the preceding preferred versions thereof at least one of the sources differs in output colour from at least one other, of the sources.

According to a sixth preferred version of the first aspect of the present invention or of any preceding preferred version thereof the body member is a sealed enclosure with conductors for electricity for powering the light sources passing through a wall of the enclosure by way of a seal.

According to a second aspect of the present invention there is provided an assembly comprising a plurality of display devices according to the first aspect or of any preferred version thereof laid out to conform to a predetermined pattern. Typically the assembly includes means for programming operation of at least some the devices included in the assembly.

According to a first preferred version of the second aspect of the present invention each of at least some of the devices in the assembly are adapted to provide a display output varying in output characteristics comprising colour, appearance or intensity with respect to time and/or rate of change of these characteristics.

BRIEF DESCRIPTION OF DRAWINGS

An exemplary embodiment of the invention will now be described with reference to the accompanying drawing of a display device of which.

MODE FOR CARRYING OUT THE INVENTION

Figure 1:
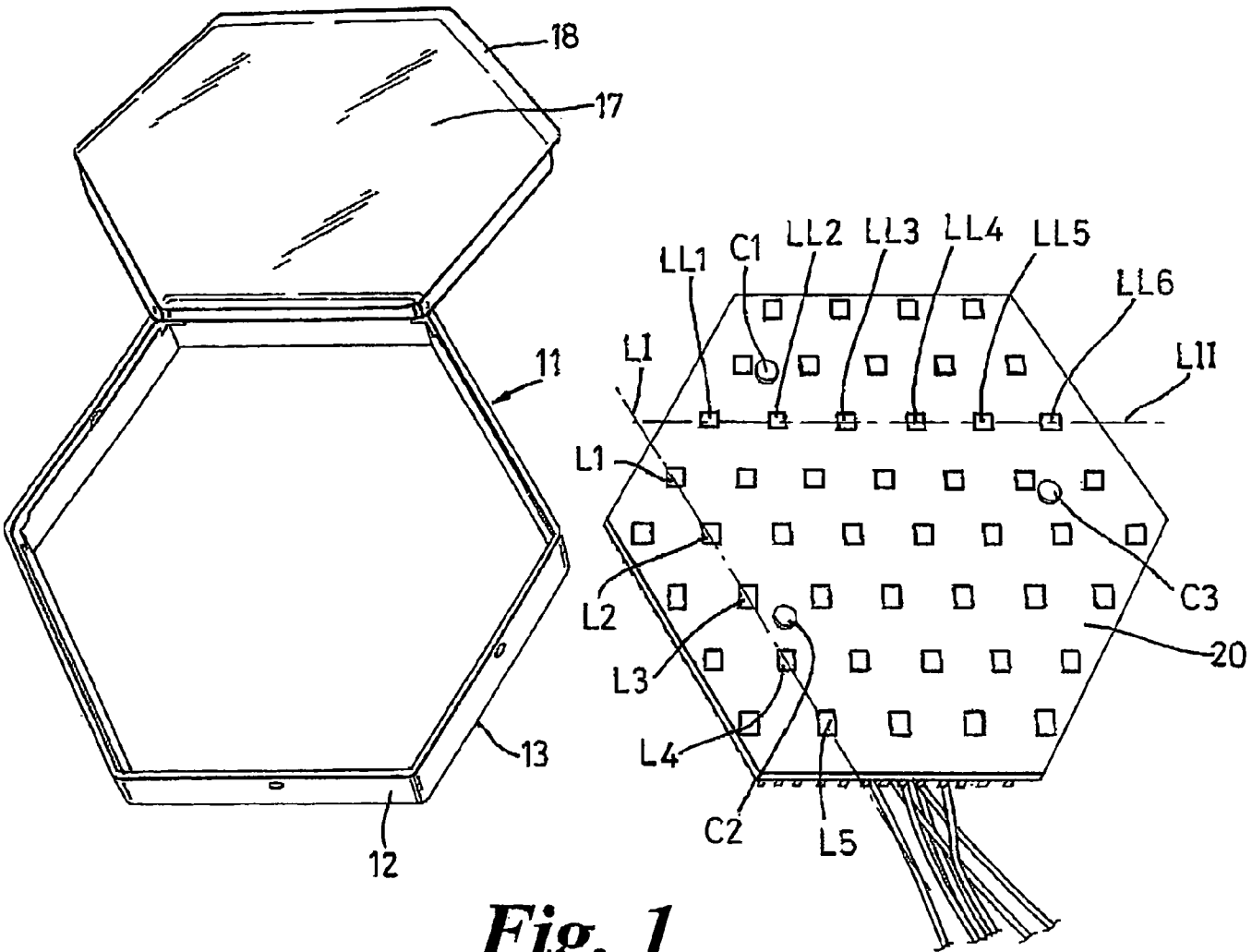
FIG. 1 is an exploded view from above.
Figure 2:
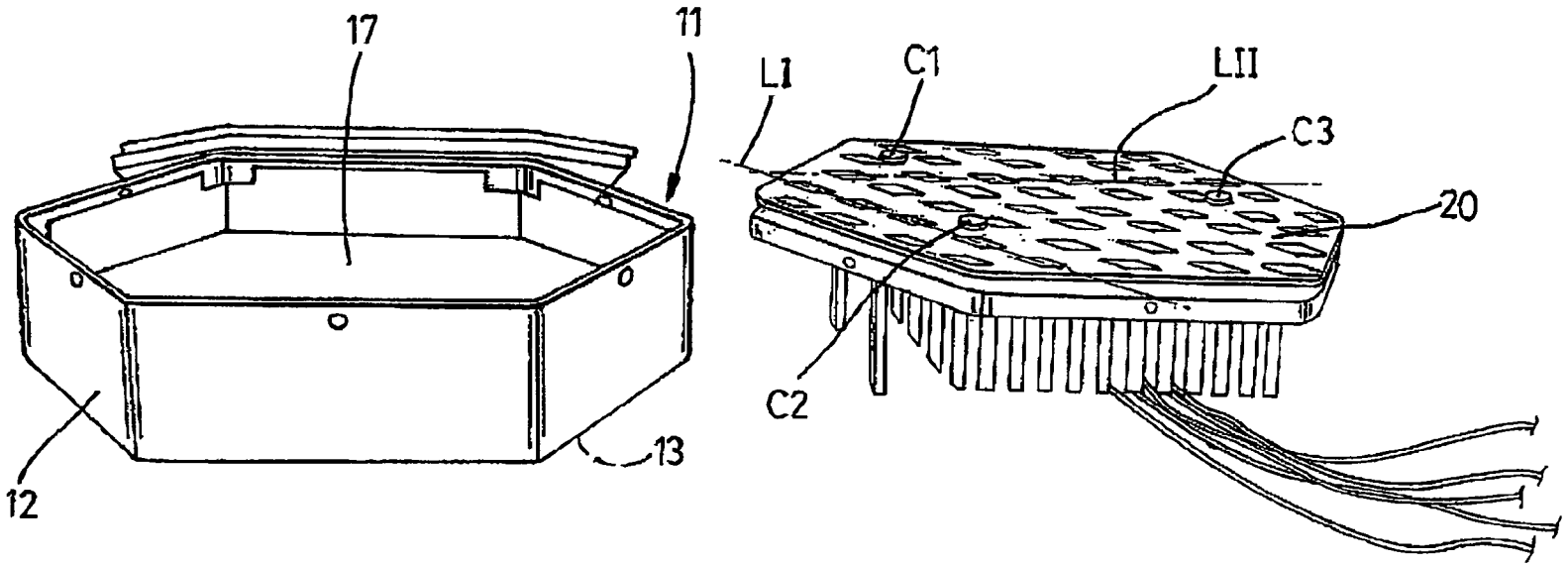
FIG. 2 is an exploded view from one side.
Figure 3:
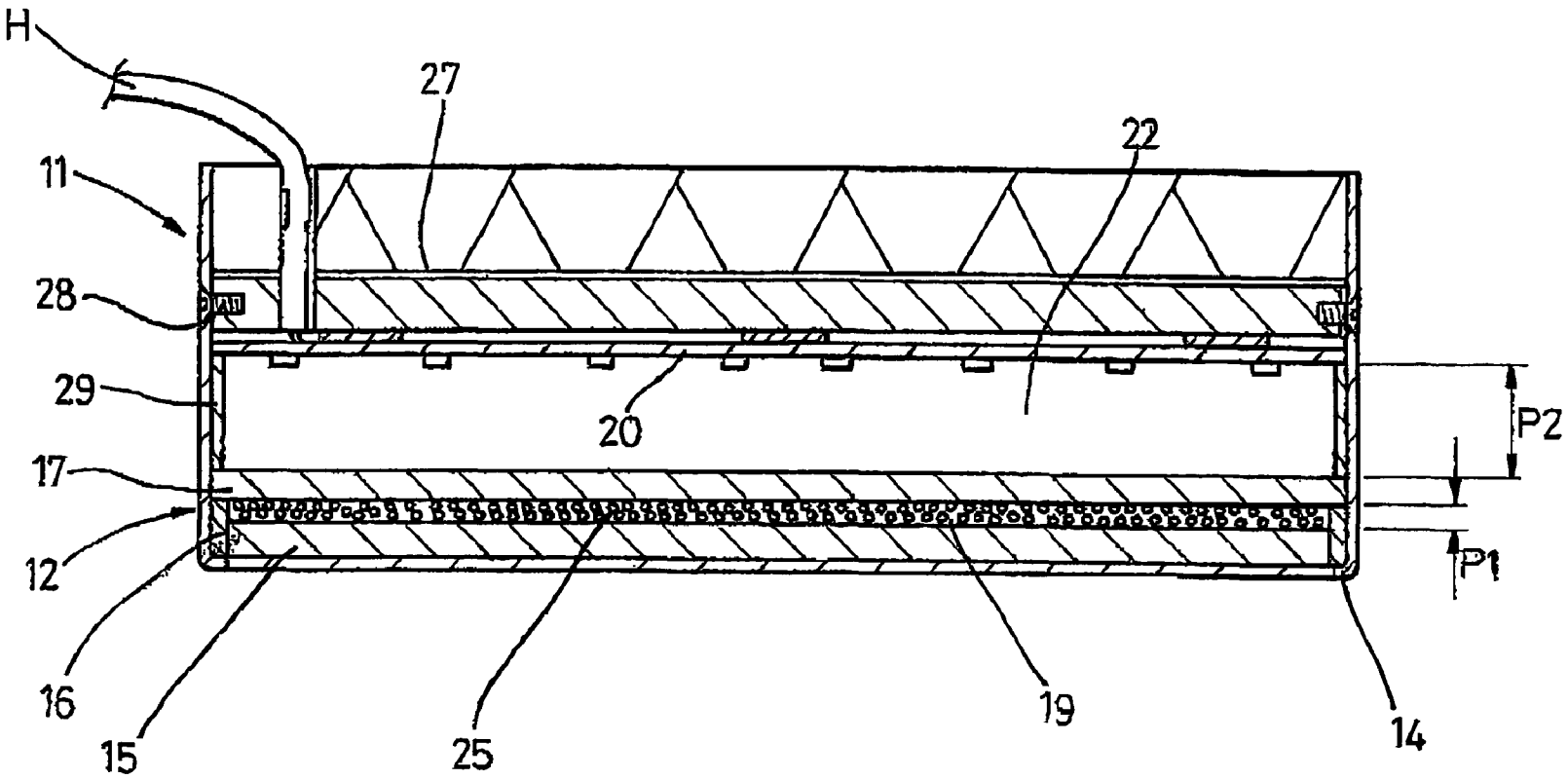
FIG. 3 is a sectional elevation of an assembled device shown in FIGS. 1 and 2.

The FIGS. 1 to 3 variously show an illumination device 11 comprising a body member 12 of metal strip. In plan view the body 12 is hexagonal in shape and at end 13 is turned inwardly to provide an integral flange 14.

A first transparent member 15 lies within the body member 12 and has a boundary 16 conforming to, and lying within, the hexagonal shape of the body 12.

A second transparent member 17 is located within, and laterally by, the body member 12. The second transparent member 17 has a boundary 18 conforming to and lying within the hexagonal shape of the body member 12. The second member 17 is spaced from the first member 15 by a distance P1 so as to provide a first plenum chamber 19 bounded by the first and second transparent body members (15, 17) and the body member (12).

A carrier 20 of hexagonal plan view has a plurality of sources of light (in this case forty-eight LED's laid out on a triangular pitch). Typically line LI contains LED's L1 to L5 and line II contains LED's LL1 to LL6. The carrier 20 is laterally located by the sides of body member 12 and spaced from the second transparent member 17 by a distance P2 so as to provide a second plenum chamber 22 bounded by the carrier 20, the second transparent member 17 and the body member 12. The carrier 20 is positioned so that the plurality of LED's are directed into the second plenum chamber 22. The carrier 20 is provided with spacing means in the form of a peripheral distance piece 29, serving to provide for the distancing of the carrier 20 from the second transparent member 17 by the distance P2.

The first plenum chamber 19 has a close packed filling 25 of optical particles—in this case balls of glass. The sizes of the particles are selected to lie in a range of sizes varying between 600 microns and 1800 microns. This provides for a suitably close packed filling 25 providing the required viewing appearance of the device. The proportion of each given size in the range is selected in dependence on the nature of the required display.

A closure member 27 is provided for, and secured by set screws 28 to, the body member 12 to ensure that the distance piece 29 is maintained in contact with the second transparent member 16 so that the member 16 provides for compressive loading of the filling 25. The pressure required depends on a number of factors but is concerned with ensuring that the filling 25 remains a whole optical mass of uniform density with no gaps appearing which could, for example, lead to an LED from the plurality on the carrier 20 being visible through a gap in the filling 25. Factors needing to take into account whether the device 11 is assembled include the use to which it is likely to be put. Typically in the event of vibration when in use the filling should be already be close packed enough for no further packing to occur or at least not to an extent where voidage can arise giving rise to an unsatisfactory display if not exposure of an LED.

The array of LED's on the carrier 20 is in this case powered by way of a harness H on the upper side of the carrier 20 (as viewed in FIG. 2). In this case the harness H leads into processing means which are operable by an external central, controlling data processor to provide for the required display. The device 11 is readily mounted in a display (see FIG. 4) along with a number of other related display devices so that a central processor can provide for a required display, whether static or dynamic, by the collection of display devices as a single display.

The filling 25 provides a diffusion path for light from the LED's illuminated on the carrier 20. With the LED's energized by way of the harness H (in response to a control input) light from each LED passes across second plenum chamber 22 and by way of second transparent member 17 into the first plenum chamber 18 and so into filling 25 from whence out of the device 11 by way of first transparency member 15. The relative distances P1, P2 are chosen to provide the required, appearance of the display device when illuminated.

With the presently proposed configuration, light from the carrier LED's is not significantly attenuated by the filling 25. As a result the frontal appearance of the device 11 does not reveal each LED as a discrete source of light but rather a uniformly and homogeneously bright surface in appearance. Without the filling 25 and so the diffusion effect it provides, a direct viewing of the energized LED array by an observer of average eyesight may be likely to cause significant dazzling. With the filling 25 in place the resulting diffusing results in the dazzling effect being substantially reduced if not eliminated. However it is not likely that the LED's will be uniformly energized since the present display device ambles a range of effects to be produced. As mentioned earlier a particular application of the present invention would provide for a number of the described devices, which could be a large number, laid out on a predetermined pattern (which could be in one or more layers and could be a non-plane mounting surface or surfaces. By making use of control processor a variety of display effects are readily obtained including ones which could include colour.

The body member 12 in the particular embodiment is hexagonal in plan view. A display unit can be provided of any required shape and can be symmetrical or asymmetrical. In this case the LED's on carrier 20 are in the form of a uniformly laid out array on a triangular pitch. However in other embodiments the layout does not have to be uniformly laid out and can include pitched and/or non pitched versions. Consequently a display device according to the present invention can be made up in a configuration appropriate for use in one or more of a wide range of possible applications. In many applications space and/or access can be limited. The components making up the present device are inherently stable and the device is not subject to significant thermal cycling as would arise from the use of light sources based on resistive elements.

The optical particles in the filling 25 in the exemplary embodiment are glass balls with sizes chosen to lie in a spectrum of sizes. A wide range of glasses are available from which the balls can be selected according to design criteria for a given application. Other optical particles can be including ones of naturally occurring or man made material. Mixtures of such material could be used for particular applications where a particular optical effect is needed.

The optical particles in a given filling can be uniform in colour or vary in colour quite apart from colour provided by way of the LED array.

Figure 4:
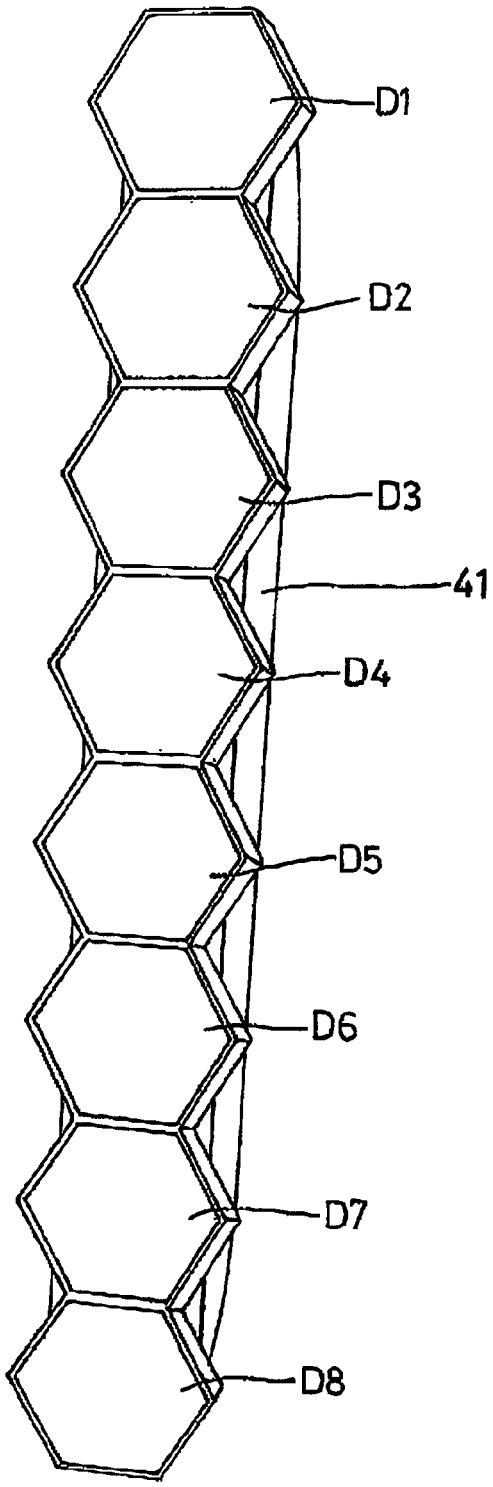
FIG. 4 is a perspective view of a number of assembled display devices.

FIG. 4 shows a plurality of eight display devices D1-D8, each according to the device shown and described in FIGS. 1 to 3, mounted on a batten 41. The harness from each device is linked in the batten which also incorporates processing means from this group of display devices. This display shows a simple array of the devices for decorative purposes in a lobby, public area or in a vehicle. A large range of possibilities exist in which the display device can be used. Each device operates at a low voltage with little heat generation. Even in the event of physical damage exposing the interior of one or more devices the fire risk is very low.

INDUSTRIAL APPLICABILITY

While the display device of the present invention has been described in relation to a decorative use it could also be used, for example, for signaling or information display.

The invention claimed is:

1. A display device comprising:

a body member having a side member which, in plan view, conforms to a first profile; characterized by a first transparent member (15) located within, and by, the body member (12), the first transparent member (15) having a boundary (16) conforming to and lying within the first profile, a second transparent member (17) located within, and by, the body member (12), the second transparent member (17) having a boundary (18) conforming to and lying within the first profile and being spaced from the first transparent member (15) so as to provide a first plenum chamber (19) bounded by the first and second transparent body members (15, 17) and the body member (12);

a carrier (20) having a plurality of sources of light (L1 to L5, LL1 to LL6 . . . ) located on it located by the body member (12) and spaced from the second transparent member (17) on the opposite side of the second transparent member (17) to the first plenum chamber (19) so as to provide a second plenum chamber (22) bounded by the carrier (20), the second transparent body member (17) and the body member (12); the plurality of lights being directed into the second plenum chamber (22);

spacing means (29) providing for the distancing of the carrier (20) from the second transparent member (17) by a predetermined amount (P2);

a closure member (27) for, and secured to, the body member (12)

the first plenum chamber (15) having a filling (25) of optical particles and the carrier (20) serving to load the second transparent member (17) by way of the spacing means (29) so that the filling (25) is maintained as a pressurized mass of particles; and means (H) providing for the plurality of sources of light to be connectable to at least one source of power to enable at least one of the sources to be energized.

2. The display device as claimed in claim 1, wherein each source of light (L1 to L5, LL1 to LL6 . . . ) is a light emitting solid state device and the optical particles (25) are glass balls.

3. The display device as claimed in claim 1, wherein the optical particles (25) are of uniform size and shape.

4. The display device as claimed in claim 3, wherein the optical particles (25) are of similar shape.

5. The display device as claimed in claim 1, wherein the optical particles (25) vary in size over a spectrum of sizes.

6. The display device as claimed in claim 1, wherein at least one of the sources (L1 to L5, LL1 to LL6 . . . ) differs in output color from at least one other of the sources.

7. The display device as claimed in claim 1, wherein the body member (12) is a sealed enclosure with conductors (H) for electricity for powering the light sources passing through a wall of the enclosure by way of a gas tight seal.

8. A display unit comprising a plurality of display devices comprising:

a body member having a side member which, in plan view, conforms to a first profile;

a first transparent member (15) located within, and by, the body member (12) the first transparent member (15) having a boundary (16) conforming to and lying within the first profile, a second transparent member (17) located within, and by, the body member (12) the second transparent member (17) having a boundary (18) conforming to and lying within the first profile and being spaced from the first transparent member (15) so as to provide a first plenum chamber (19) bounded by the first and second transparent body members (15, 17) and the body member (12);

a carrier (20) having a plurality of sources of light (L1 to L5, LL1 to LL6 . . . ) located on it located by the body member (12) and spaced from the second transparent member (17) on the opposite side of the second transparent member (17) to the first plenum chamber (19) so as to provide a second plenum chamber (22) bounded by the carder (20), the second transparent body member (17) and the body member (12); the plurality of lights being directed into the second plenum chamber (22);

spacing means (29) providing for the distancing of the carrier (20) from the second transparent member (17) by a predetermined amount (P2);

a closure member (27) for, and secured to, the body member (12)

the first plenum chamber (15) having a filling (25) of chips or balls of glass and the carrier (20) serving to load the second transparent member (17) by way of the spacing means (29) so that the filling (25) is maintained as a pressurized mass of particles; and means (H) providing for the plurality of sources of light to be connectable to at least one source of power to enable at least one of the sources to be energized, the devices being laid out to conform to a predetermined display pattern defined by the unit.

9. The display unit as claimed in claim 8, including control means for programming operation of at least some the devices making up the pattern.

10. The display unit as claimed in claim 8, wherein at least one of the plurality of devices is adapted to provide a display output varying in output characteristics of the group comprising color, appearance or intensity with respect to time or rate of change of the characteristic.

11. A display device comprising:

a body (12) having side walls that define a first profile;

a solid first transparent member (15) having a boundary (16) that spans a perimeter of the first transparent member (15) and communicates with the side walls of the body (12) to secure the first transparent member (15) within the body (12)

a solid second transparent member (17) has a perimeter with a form of the first profile such that the perimeter of the second transparent member (17) is closely associated with the walls of the body (12), the first transparent member (15) is spaced from the second transparent member (17) such that the first and the second transparent members (15, 17) and the body member (12) define a first plenum chamber (19) having an initial volume, the second transparent member (17) is securable in relation to the first transparent member (15) and the walls of the body (12) to compress a compressible layer of a filling (25) of discrete optical particles which are housed within the first plenum chamber (19) and diffuse light passing therethrough;

a carrier (20) has a perimeter with a form of the first profile such that the perimeter of the carrier (20) is closely associated with the walls of the body (12), the carrier (20) supports a plurality of light sources (L1 to L5, LL1 to LL6 . . . ), which are directed at the second transparent member (17), and is spaced from the second transparent member (17) by a spacer (29) such that the carrier (20) is separated from the second transparent member (17) by a predetermined distance (P2), the carrier (20), the second transparent member (17) and the walls of the body (12) defining a second plenum chamber (22);

a closure member (27) communicates with the carrier (20) and is securable to the walls of the body member (12) such that as a force is applied to the closure member (27), each of the carrier (20), the spacer (29) and the second transparent member (17) are commonly loaded toward the first transparent member (15) such that the compressible layer of the filling (25) in the first plenum chamber (19) is compressed and the initial volume of the first plenum chamber (19) is reduced; and a power source (H) communicating with the plurality of light sources (L1 to L5, LL1 to LL6. . . ) to energized at least one of the plurality of light sources (L1 to L5, LL1 to LL6 . . . ).

12. The display device according to claim 11, wherein the discrete optical particles are of uniform size and shape.

13. The display device according to claim 11, wherein the discrete optical particles range in size from approximately 600 microns to approximately 1800 microns.

14. The display device according to claim 11, wherein the discrete optical particles are of similar shape.

15. The display device according to claim 11, wherein the second plenum chamber (22), the second transparent member (17), the first plenum chamber (18), the filling (25) and the first transparent member (15) being arranged such that light from the plurality of light sources (L1 to L5, LL1 to LL6 . . . ) only passes through the second plenum chamber (22), the second transparent member (17), the first plenum chamber (18), the filling (25) and the first transparent member (15) being arranged such that light from the plurality of light sources (L1 to L5, LL1 to LL6 . . . ) before leaving the display device.

* * * * *